United States Patent [19]

Arriaga-Ortiz

[11] 4,181,496

[45] Jan. 1, 1980

[54] INDUSTRIAL OVEN FOR THE CALCINING OF LIME STONE

[76] Inventor: Hector M. Arriaga-Ortiz, Simon Bolivar 150, Monterrey, Nuevo Leon, Mexico

[21] Appl. No.: 773,770

[22] Filed: Mar. 2, 1977

[51] Int. Cl.[2] ..... F27B 9/26

[52] U.S. Cl. ..... 432/137; 432/138; 432/146

[58] Field of Search ..... 432/137, 138, 146, 149, 432/241

[56] References Cited

U.S. PATENT DOCUMENTS

| | | | |
|---|---|---|---|
| 2,417,063 | 3/1947 | Cooper | 432/138 |
| 2,980,412 | 4/1961 | Koerner | 432/241 |
| 3,378,242 | 4/1968 | Cone et al. | 432/138 |

FOREIGN PATENT DOCUMENTS

| | | | |
|---|---|---|---|
| 1207907 | 2/1960 | France | 432/137 |
| 1040481 | 8/1966 | United Kingdom | 432/137 |

*Primary Examiner*—John J. Camby

*Attorney, Agent, or Firm*—Laurence R. Brown

[57] ABSTRACT

The present invention refers to improvements to an industrial oven for the calcining of lime stone, and more specifically to an oven whose combination of the means which form it makes it possible, through a horizontal process, to uniformly calcine rock or lime stone, transporting for such purpose the material to be calcined on a transporting element which glides over rollers which in turn rotate on their own axis resting on multiple points of support.

2 Claims, 6 Drawing Figures

INDUSTRIAL OVEN FOR THE CALCINING OF LIME STONE

The present invention refers to improvements to an industrial oven for the calcining of lime stone, and more specifically to an oven whose combination of the means which form it makes it possible, through a horizontal process, to uniformly calcine rock or lime stone, transporting for such purpose the material to be calcined on a transporting element which glides over rollers which in turn rotate on their own axis resting on multiple points of support.

The transporting element combines refracting means such as a base and walls, having at the sides of its lower base, sliding borders which are set in an insulating sandy medium through which it is possible to greatly reduce the loss of the heat produced inside the oven. Likewise, the oven is provided with a heating chamber set off at the top by an arched roof and at its sides by walls. The arched roof as well as the side walls are constructed of a refracting material, for preserving the heat inside the heating chamber. Likewise, this oven has combustion and heating elements which can be placed in any position as long as they provide heat to the heating chamber resulting from their combustion, the preferred embodiment being at the top of the oven, that is to say, over the arched roof, directing the combustion vertically towards the lower part. The basic functioning of vertical ovens and rotating ovens, is in accord with the idea of constructing a fire or calcining area and transporting the to be calcined rocks through this area by way of gravity.

In effect, in a vertical oven, being the oldest used, the flow of the rock load is caused by gravity when the oven discharges its load through its lower part and in the case of the rotating oven, it has been conceived as deriving from the vertical oven which has been laid down or placed in a horizontal position and has been given a rotating movement and a slight inclination on its longitudinal axis so that by means of the same gravity the flow of the rocks is produced.

The oven of the present invention has been conceived as derived from a vertical oven in horizontal position but not using gravity for the flowing of rocks, but to effect this flow by conventional mechanical means placing the rocks or oven load in special refracting containers which flow through preheating and fire areas of the oven. The improvements obtained by the use of these means over the vertical or rotating ovens are those which derive from having better conditions so that the chemical process of decomposition by heat which is the calcining process, give better distribution, transmission, regulation and efficient controls in the application of fire and heat.

One objective purpose of the present invention is to avoid the inconveniences of the ovens known to date which are used to calcine lime stone, which because of their construction have a high maintenance cost, a complicated charge and discharge system, and are limited because the calcining conditions are evidently deficient.

Another advantage afforded by the present invention is that which refers to the type of material which can be used for calcining. In the present systems, it is necessary for instance when dealing with vertical ovens to use large size lime stone rocks, or at least of a size large enough so that its weight by gravity can carry it from the top to the bottom along the oven, impeding in vertical ovens to calcine effectively small size material. On the other hand, when the calcining is done in horizontal rotating ovens, it is necessary to put into the oven small size material since otherwise it would not be possible in the first place to obtain adequate calcining, and besides, one would run the risk of destroying in varying degrees the refractory lining by the impacts which large size rocks would produce. Through the present invention it is no longer necessary to select or prepare the size of the rocks to be calcined, but rather independently of the size of the rocks to be calcined, the calcining process would be carried out through a horizontal flow which would not, in the first place affect the quality of the calcining (except to improve it) and on the other hand it would not affect the maintenance of the oven.

After laboratory tests were carried out, and as a consequence of the testing done, it has been determined that the advantages obtained by the oven of the present invention, over vertical and rotating ovens and others known to date for the calcining of lime stone are as follows; ease in obtaining and maintaining a predetermined calcining curve in relationship with the composition, characteristics and size of the lime stone to be calcined; the convenience of effecting an automatic control; lower fuel consumption; freedom from systhematic maintenance of the curved roof and interior walls of the oven; ease in effecting the charging and discharging operations of the oven; quick and easy construction and installation for quick investment recovery and quick benefits; a low capital investment per annual ton; ease to obtain and to make good use of the production of carbon dioxide; working space at ground level without having the risk of heights, and decreased need for vigilance by oven crew.

Likewise with the proof of the calcining curves which have been determined in the oven operation and with the automatic control for different sizes of rock, it has been possible to show a maximum benefit in the exploitation of the the rock. On the other hand, the total absence of systhematic maintenance of the walls and curved roof of the oven due to the fact that in the present invention there is no contact, friction or impact by the rocks against the refractory lining, is another of the notable advantages which is obtained through the present invention.

Additional advantages are the fact that in the present invention the charging and discharging of the oven is extremely simple since when loading at ground level by manual or automatic means, each one of the transporting elements will be loaded with ease can later be discharged with the same ease. Additionally, in relation to the refractory trays or platforms it is wise to note that these are much more economical than the trams required by other oven systems and to this one must add the great advantage of the rollers or sliding system over which the trays travel which is very efficient, simple and economical in its maintenance besides being resistant to the weight which it can carry at a given moment.

The characteristic details of the present invention are clearly shown in the following description of the drawings which accompany it as an illustration of the same and using the same reference symbols to point out the same parts in the figures shown.

Figure 1:
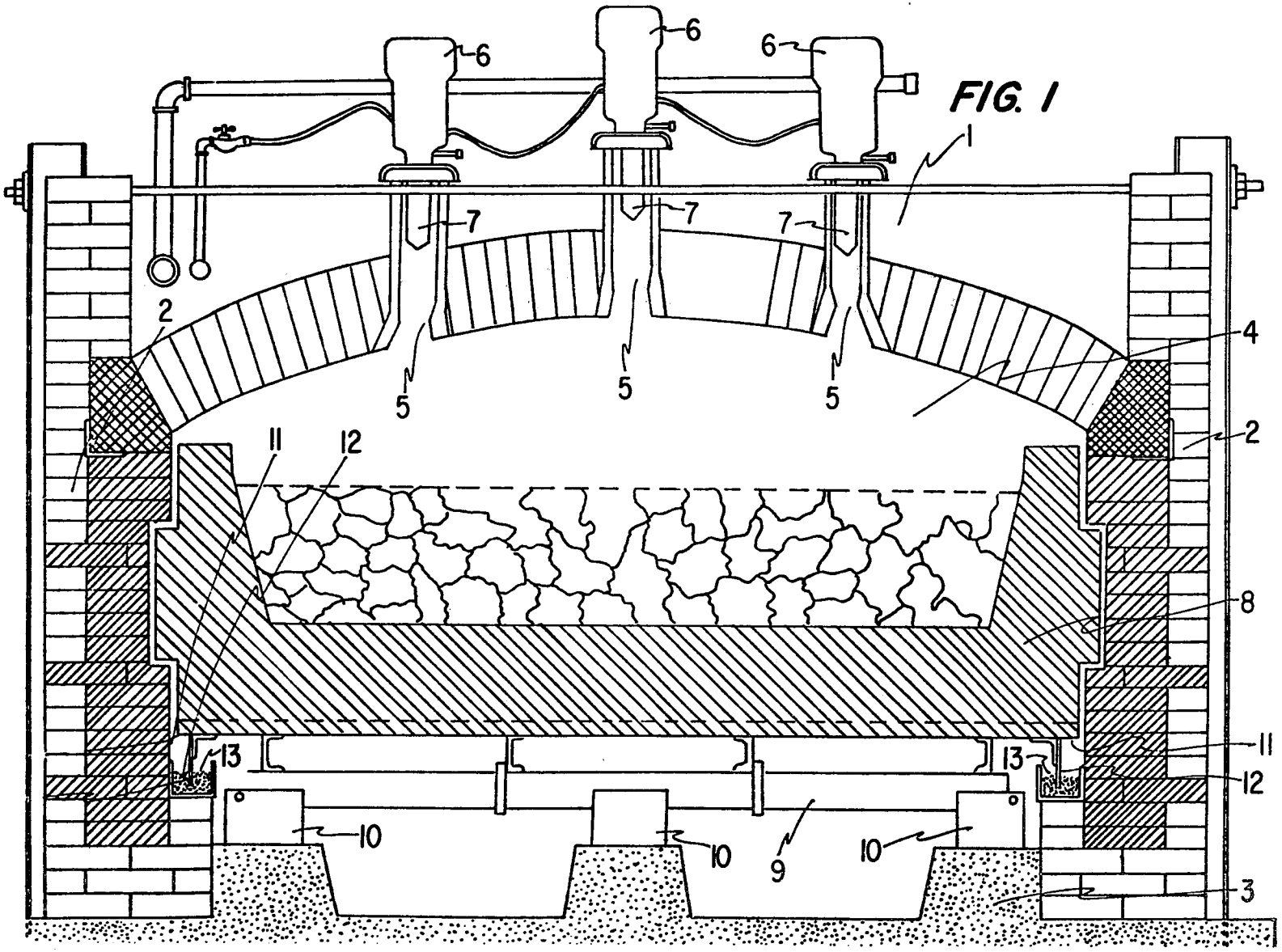
FIG. 1, shows a cross sectional view of the oven unit, supporting elements and transporting element.
Figure 2:
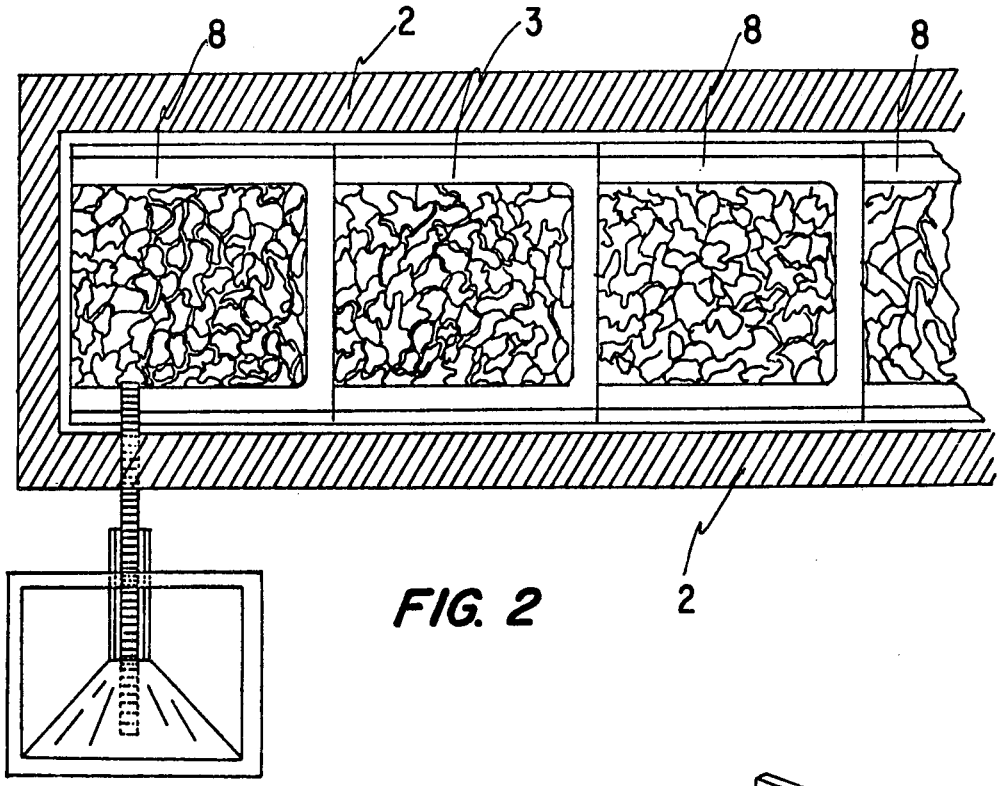
FIG. 2, shows a lengthwise cross-sectional over view of the oven unit, and transporting element.
Figure 3:
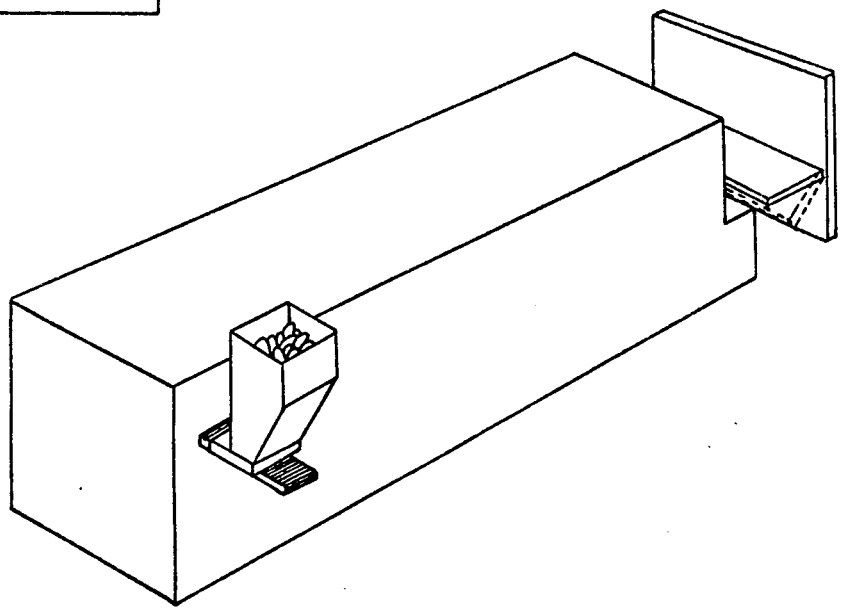
FIG. 3, shows an isometric view of the oven unit with its charging, calcining and discharging areas.
Figure 4:
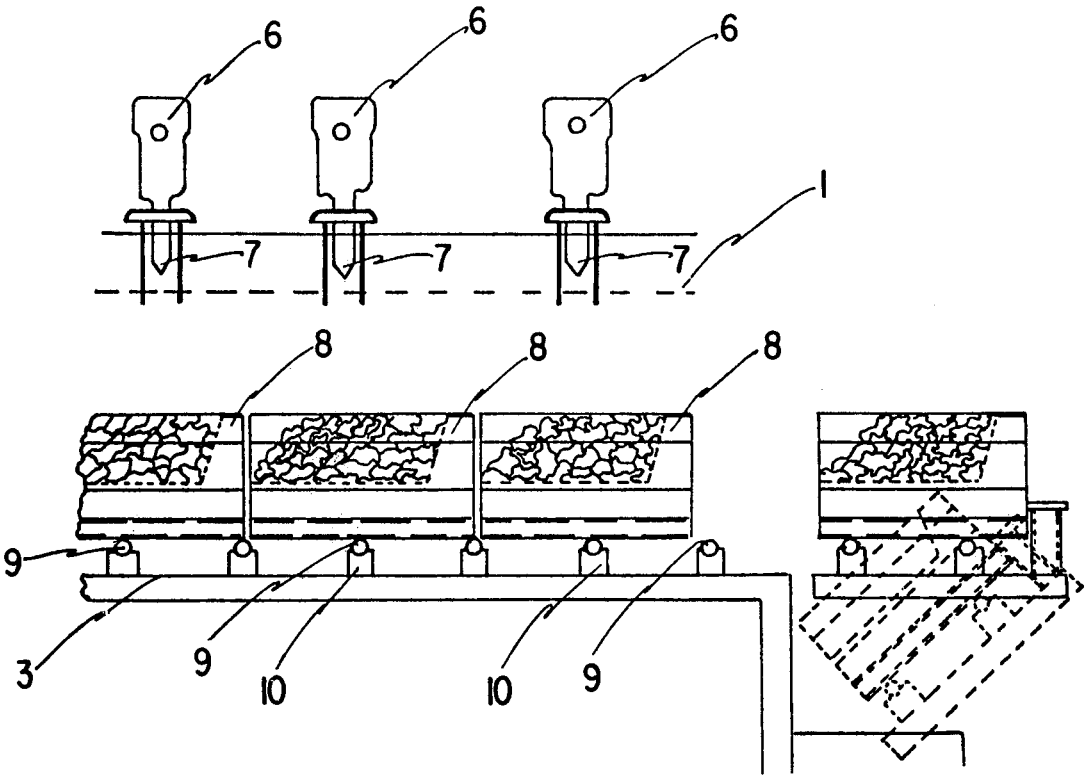
FIG. 4, shows a lengthwise view of the oven unit, rollers and transporting element.

With reference to said figures this oven is characterized by the combination of a curved roof (1) constructed of a refractory material, supported by the side walls (2) constructed of a refractory material, and the principal base (3) built as a conventional foundation either of a concrete base or other appropiate material.

The heating chamber (4) is connected to the burners (6) by means of ducts (5) through which the heat travels from the small mouthpieces (7) in which the combustion is produced. The mouthpiece (7) can be either short (as shown in the accompanying drawing) or it can be a long opening, which would be directly connected to the heating chamber (4). The burners (6) can be placed in a conventional way in any part of the oven, provided that the mouthpieces (7) lead to the heating chamber (4) in such a manner that the same may receive the heat in its very best conditions.

The transporting element (8) may be of various shapes (as shown in the accompanying drawings), but nevertheless it has been decided, after tests done that the ideal one is the one described next: A transporting element (8) which consists of a tray manufactured of refractory material which slides along the heating chamber (4) propelled by any conventional means. The transporting element (8), in the present embodiment rides over rollers (9) arranged parallel to each other transverse along the heating chamber (4). These rollers (9) (which may vary in number), are rested on supporting elements (10) and it is over these supporting elements (10) that the rollers (9) turn when the transporting element (8) demands it.

The transporting element (8) has along the ends (11) of its lower base with borders (12), which are set in a sandy medium (13) preferably, and it is precisely such mechanism which makes it possible to seal the heating chamber (4) in such a way as to greatly reduce the loss of heat to the outside.

Figure 5:
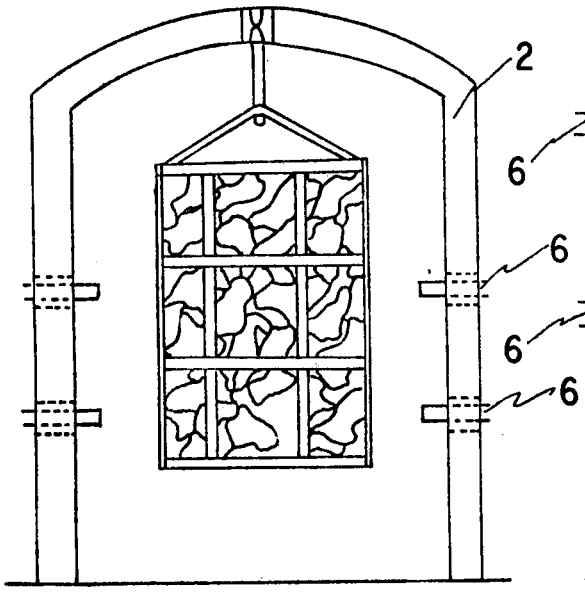
FIGS. 5 and 6 show two possible embodiments of the transporting element.
Figure 6:
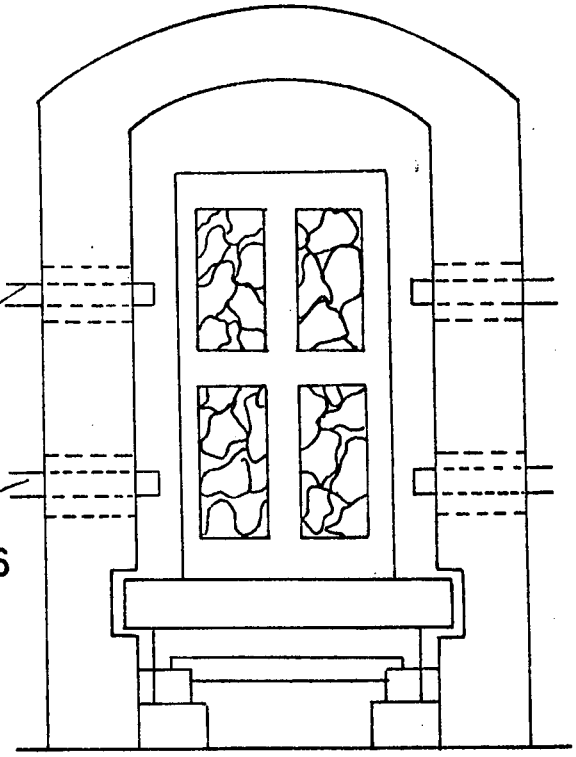

As can be seen by the alternate embodiments of FIGS. 5 and 6, the transporting element (8) may vary in its shape as well as in the arrangement of its means, and it can be a basket with a cage or any other adequate receptacle.

The oven is not limited to a straight design as is shown in the accompanying drawings but may have the shape of a horseshoe or even that of an incomplete circle, in such a way that the charging and discharging area may be located at a prudent distance so that the personnel which is to handle the oven may be notably restricted without need to reduce the production rhythm. It is not the intention to limit the scope of his invention to the figures and descriptions herein made, but to claim any mechanism which following the described principles produce the same industrial results.

What I claim is:

1. An industrial oven for calcining lime stone or the like comprising a base, side walls supportingly connected to the base, a curved roof supported by the side walls, the roof, side walls, and base forming a heating chamber, at least one burner disposed in the upper portion of the heating chamber, a duct cooperatively communicating with the burner, a mouthpiece attached to the duct, the duct and the mouthpiece connecting the burner to the heating chamber, the mouthpiece penetrating into the ducts and carrying combustion heat into the heating chamber, a transport element movably supported upon the base, and means for moving the transport element, said means comprising a set of rollers disposed parallel to each other and transverse along the heating chamber, support elements securingly connected to the base, the rollers being rollably supported and constrained against longitudinal movement by the support elements, the transport element being rollably supported at a lower portion by the rollers.

2. The industrial oven of claim 1 wherein the oven further comprises ends provided on the lower portion, borders disposed along the ends, a sandy medium disposed in proximity to the lower portion, and means for supporting the sandy medium with respect to the base, the borders being disposed in the sandy medium.

* * * * *